US007078654B1

(12) United States Patent
Tsen

(10) Patent No.: US 7,078,654 B1
(45) Date of Patent: Jul. 18, 2006

(54) HAIL CURLER HEATER DEVICE WITH HEATER ELEMENTS ON HEAT-CONDUCTING SUPPORTS

(76) Inventor: Samson Tsen, No.8, Lane 249, Lung-Chiang Rd., Chung-Shan Dist., Taipei City (TW)

( * ) Notice: Subject to any disclaimer, the term of this patent is extended or adjusted under 35 U.S.C. 154(b) by 0 days.

(21) Appl. No.: 11/150,244

(22) Filed: Jun. 13, 2005

(51) Int. Cl.
*A45D 4/00* (2006.01)
*H05B 3/00* (2006.01)

(52) U.S. Cl. ..... 219/222; 219/521; 219/530

(58) Field of Classification Search ..... 219/222, 219/223, 521, 385, 530, 540; 132/269, 229
See application file for complete search history.

(56) References Cited

U.S. PATENT DOCUMENTS 3,473,005 A * 10/1969 Grandinetti ..... 219/222
3,541,302 A * 11/1970 Makino ..... 219/222
3,610,878 A * 10/1971 Thomas et al. ..... 219/222
3,705,974 A * 12/1972 Nilsson ..... 219/222
4,624,271 A * 11/1986 Kin ..... 132/229
5,033,487 A 7/1991 Barradas
5,076,299 A 12/1991 Wistrand et al.
6,499,195 B1 * 12/2002 Wong ..... 219/222
2004/0222205 A1 * 11/2004 Carpenter ..... 219/222

FOREIGN PATENT DOCUMENTS

JP 51-112653 * 10/1976
JP 8-66223 * 3/1996
JP 11-265499 * 9/1999

* cited by examiner

*Primary Examiner*—John A. Jeffrey
(74) *Attorney, Agent, or Firm*—Birch, Stewart, Kolasch & Birch, LLP

(57) ABSTRACT

A heater device for hair curlers has an upper hood and a lower casing forming a disposing space for hair curlers. A disposing seat is installed inside the disposing space and multiple heater supports having the same number as the hair curlers are installed on the disposing seat. A heater part is installed on the heater supports. The heater part has a heater element coupled to an external power source and generating heat, and multiple heat-conducting elements overlaying the heater element to receive the heat from the heater element and to increase heat-conducting area. The hair curlers hood the heat-conducting elements in order to achieve a rapid and uniform heating.

8 Claims, 7 Drawing Sheets

HAIL CURLER HEATER DEVICE WITH HEATER ELEMENTS ON HEAT-CONDUCTING SUPPORTS

FIELD OF THE INVENTION

The present invention relates to a heater device for hair curlers, particularly to a heater device for hair curlers heating hair curlers used to implement a human hair curling.

BACKGROUND OF THE INVENTION

U.S. Pat. No. 5,076,299 and No. 5,033,487 disclose a hair curler A1, which is heated by a heater and enables a hair curling to be easily performed with the hair curlers A1 and without any chemical agent. The hair curler A1 has a hollow heat-receiving cylinder A2 and a wrapping shell A3 extending outward from the flange of A2's end. The current heater device for hair curlers A1 is shown in FIG. 1 PRIOR ART. An upper hood and a lower casing form a disposing space for hair curlers A1. A disposing seat, which has multiple heating cylinders of the same number as the hair curlers, is installed inside the disposing space. A heater part coupled to an external power source is attached to the bottom of the disposing seat. The heater part comprises: an electrothermal plate B1; a heat-conducting plate B2, which is attached to the disposing seat and the electrothermal plate B1 and contacts the bottom ends of the heater cylinders; and a fixing plate B3 attached to the bottom of the electrothermal plate B1. When undertaking hair curling, the user hoods the heat-receiving cylinder A2 of the hair curler A1 over the heating cylinder. The heat created by the electrothermal plate B1 is spread by the heat-conducting plate B2 and conducted upward to the heating cylinders via the contact between the heat-conducting plate B2 and the bottom ends of the heating cylinders. Thus, the heat-receiving cylinders A2 of the hair curlers A1 neighboring the heating cylinders are heated and accumulate energy. Then, the user takes out the heated hair curlers A1 and winds hair over the heat-receiving cylinders A2 and uses the wrapping shells A3 to confine the hair. Thus, the heat accumulated inside heat-receiving cylinders A2 can make the hair curled for a period of time.

In the conventional technology described above, the heat created by the electrothermal plate B1 is transmitted through the heat-conducting plate B2 to the heating cylinders; however, there is only a ring-type contact between the heat-conducting plate B2 and the heating cylinder; therefore, the heat conduction speed is pretty low, and there is a temperature difference between the top and the bottom of the heating cylinder, and the heat cannot be uniformly accumulated from the top to the bottom of the heat-receiving cylinders A2 of the hair curlers A1. Thus, the curling extent of the hair wound over the same heat-receiving cylinders A2 will vary, and the hair curling effect will be influenced.

SUMMARY OF THE INVENTION

The primary objective of the present invention is to provide a heater device for hair curlers in order to solve the aforementioned problems. The heater device for hair curlers of the present invention has an upper hood and a lower casing to form a disposing space for hair curlers. A disposing seat is installed inside the disposing space. Multiple heater supports having the same number as the hair curlers are installed on the disposing seat. A heater part is installed on those heater supports. The heater part comprises: a heater element directly installed on those heater supports and coupled to an external power source; and multiple heat-conducting elements receiving the heat from the heater element and increasing heat-conducting area. The hair curlers hood those heat-conducting elements to achieve a rapid and uniform heating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The detailed description and the technical contents of the present invention are to be stated below in cooperation with the attached drawings.

Figure 1:
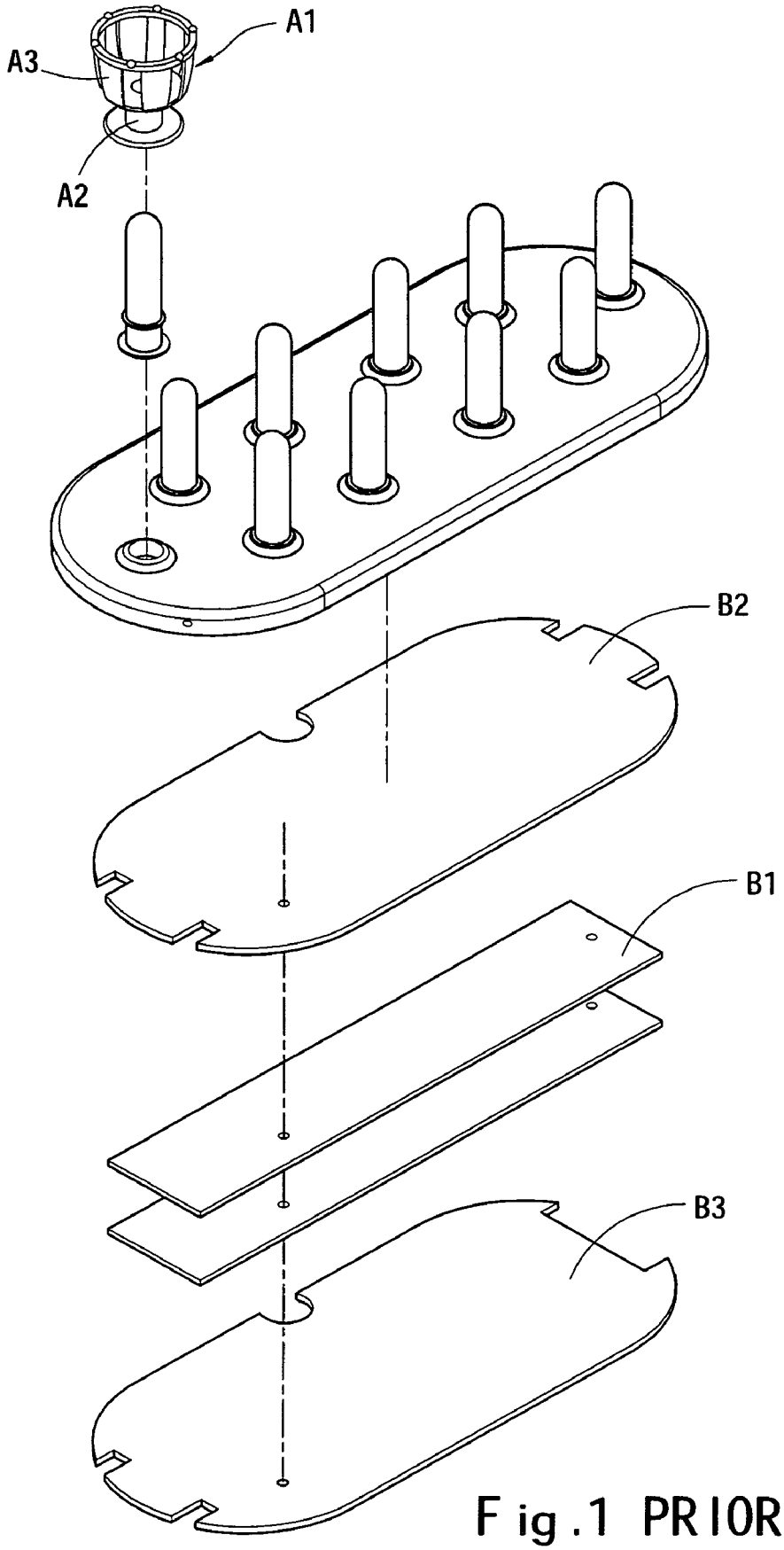
Fig.1 PRIOR ART
FIG. 1 PRIOR ART is a schematic exploded view of the structure of a conventional heater device for hair curlers.
Figure 2:
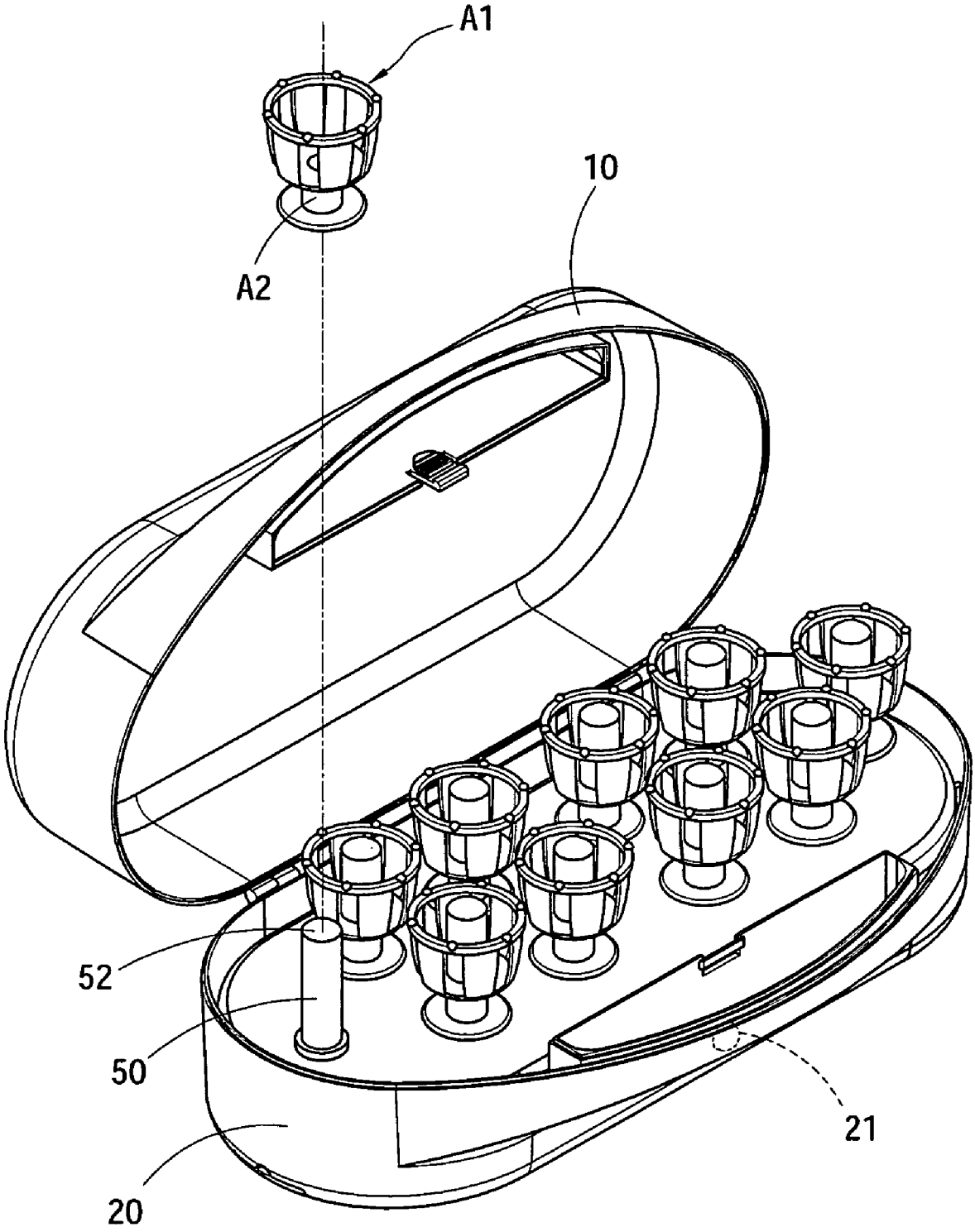
FIG. 2 is a schematic perspective view of the appearance of the heater device for hair curlers of the present invention.
Figure 3:
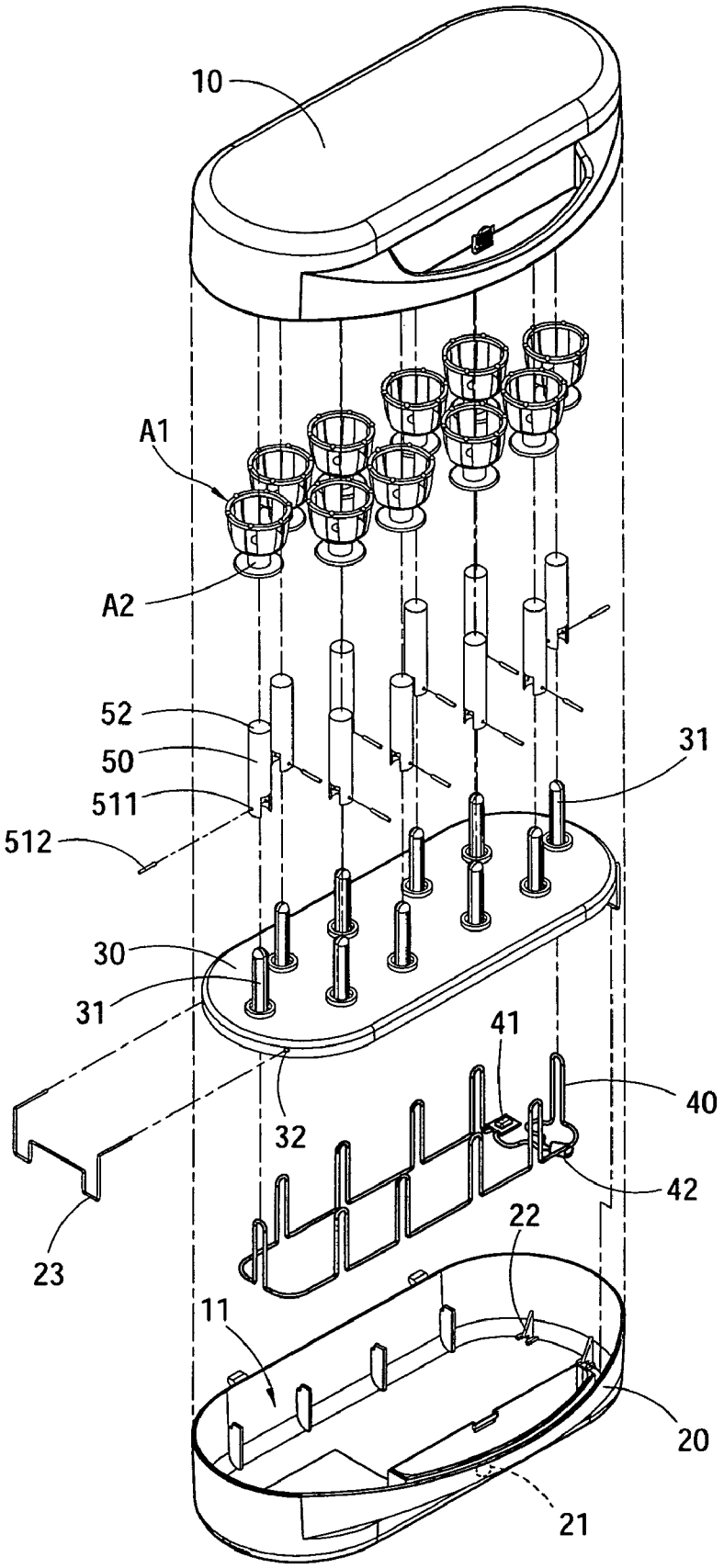
FIG. 3 is a schematic exploded view of the structure of the heater device for hair curlers of the present invention.
Figure 4:
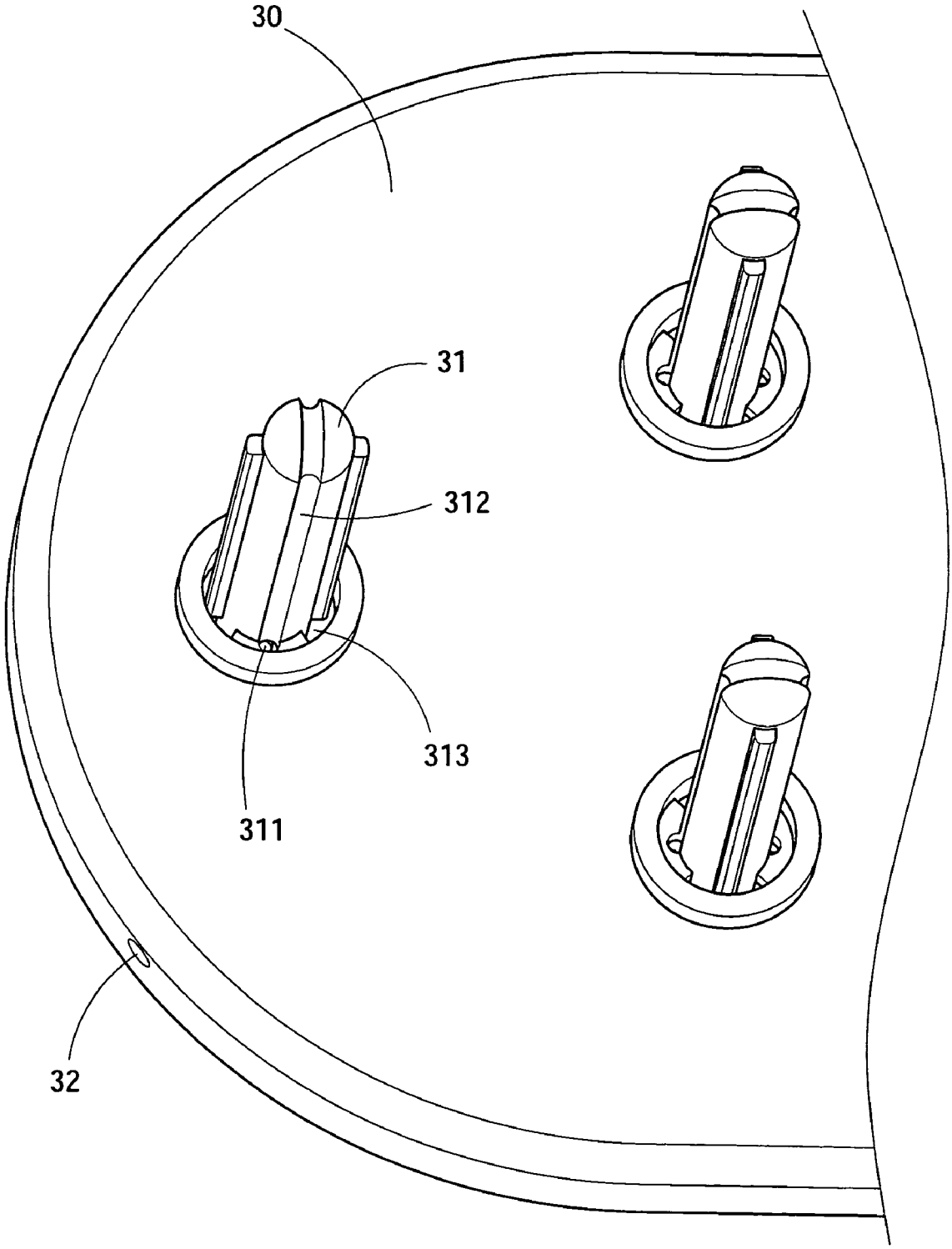
FIG. 4 is a schematic enlarged partial view of the heater device for hair curlers of the present invention.
Figure 5:
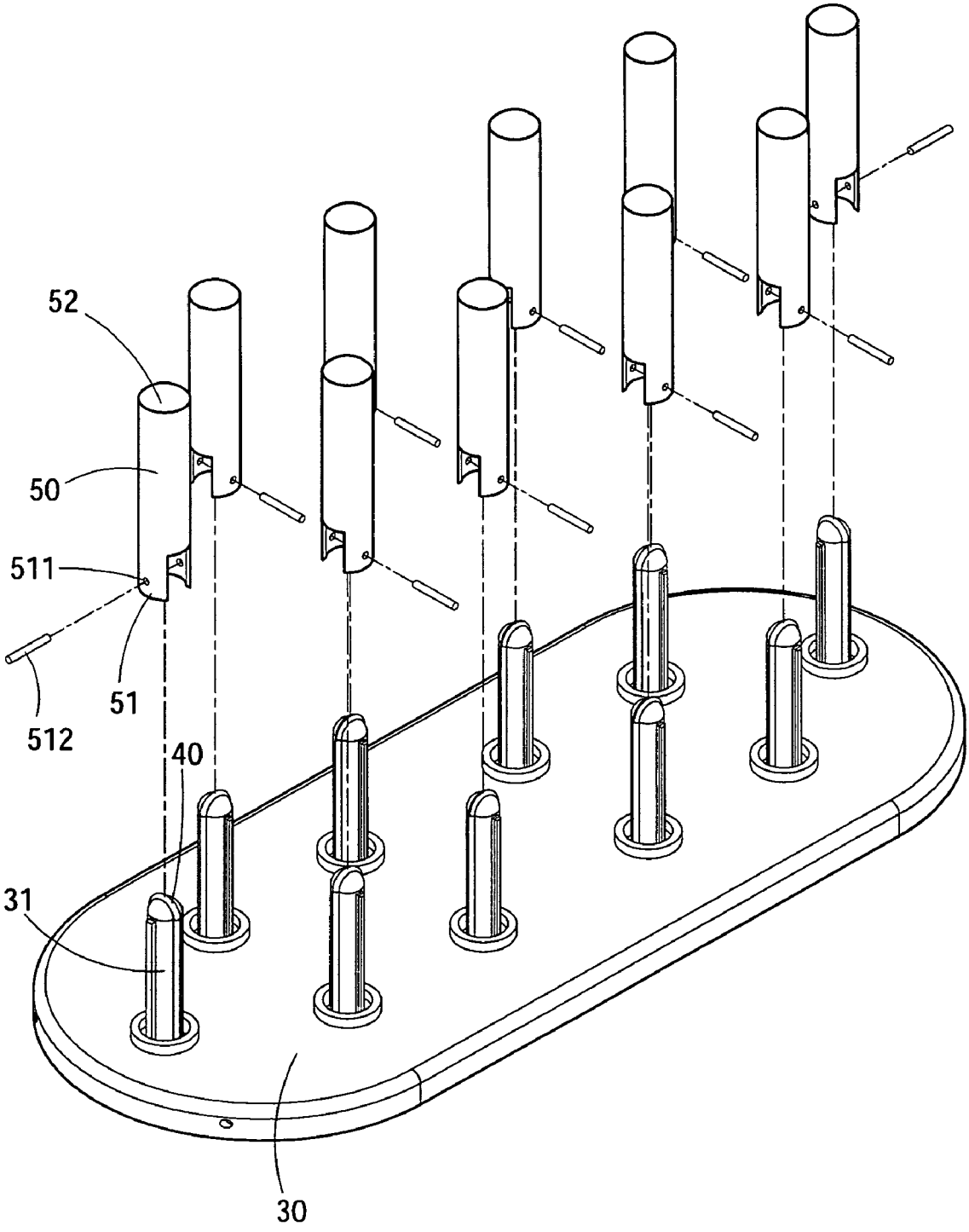
FIG. 5 is a schematic perspective view of the assembly of the disposing seat and the heating part of the heater device for hair curlers of the present invention.
Figure 6:
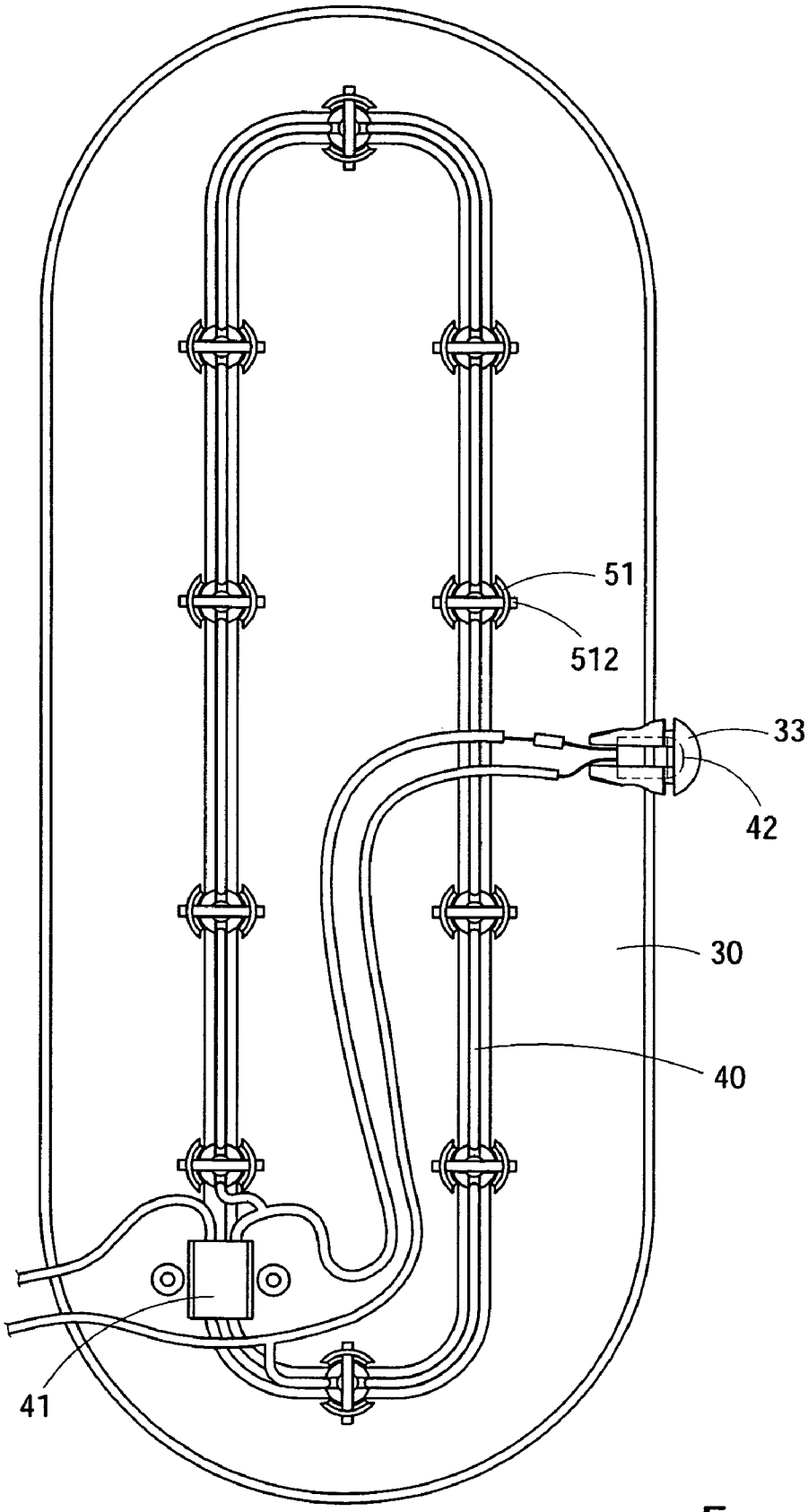
FIG. 6 is a schematic plan view of the disposing seat and the heating part of the heater device for hair curlers of the present invention.
Figure 7:
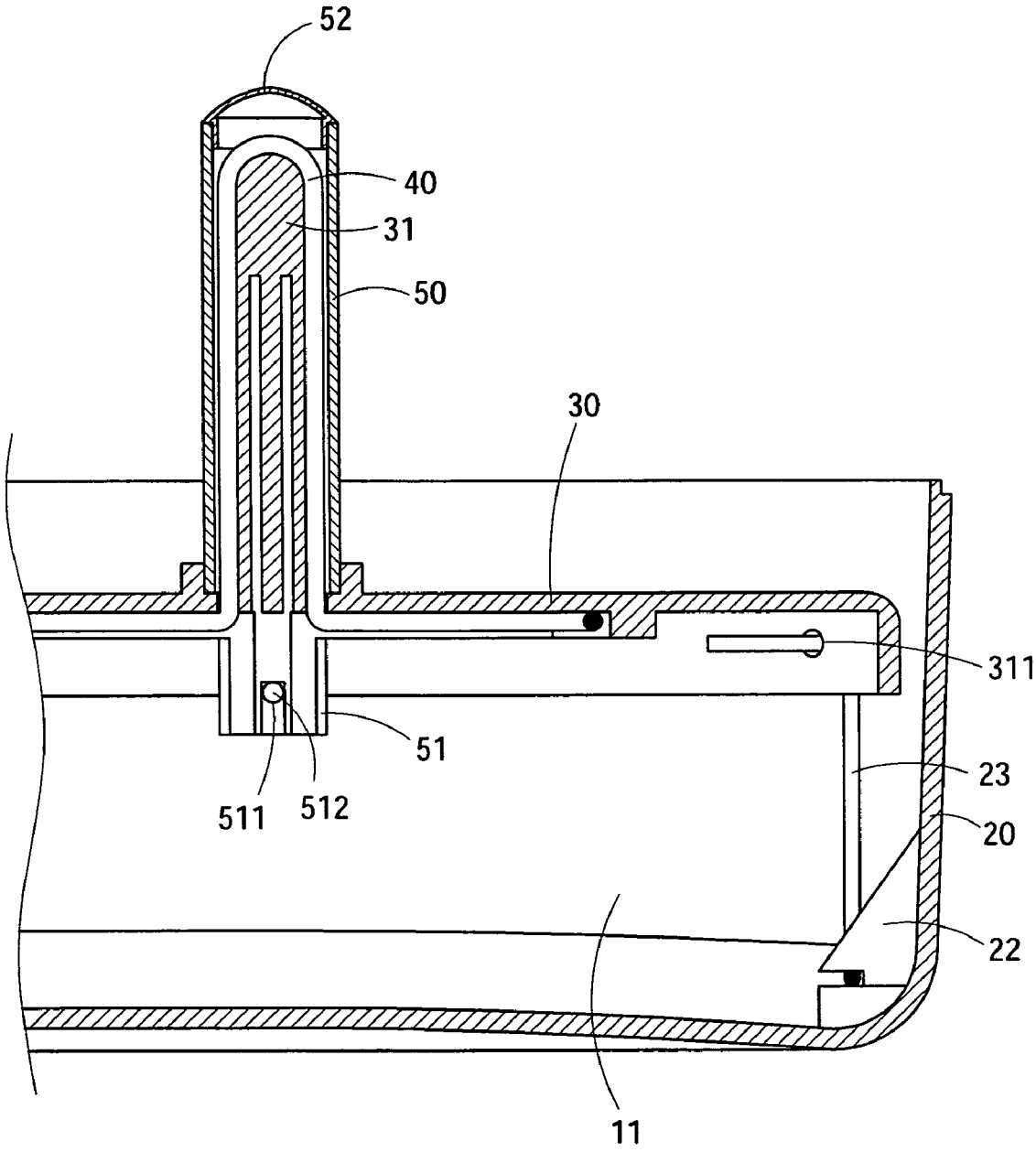
FIG. 7 is a partial section view of the assembly of the heater device for hair curlers of the present invention.

Refer to from FIG. 2 to FIG. 4 respectively showing schematically a perspective view of the appearance, an exploded view of the structure, an enlarged partial view of the heater device for hair curlers of the present invention. The present invention is a heater device for hair curlers A1, and the hair curler A1 can be but is not limited to that shown in the embodiments of the present invention, or that shown in the U.S. Pat. No. 5,076,299 and No. 5,033,487; however, the hair curler A1 should at least have a hollow heat-receiving cylinder A2. In the heater device for hair curlers of the present invention, an upper hood 10 and a lower casing 20 are pivotedly joined at one side thereof to form a disposing space 11 for the hair curlers A1. A disposing seat 30 is installed inside the disposing space 11. A fixing element 23 bent and having elasticity for snap-fit is installed between the disposing seat 30 and the lower casing 20. The disposing seat 30 has fixing holes 32 to receive the fixing element 23, and the lower casing 20 has fixing rabbets 22 to snap-fit the fixing element 23, and thus, the disposing seat 30 can be fixed. Multiple heater supports 31 having the same number as the hair curlers A1 are installed on the disposing seat 30. A heater part is installed on the heater supports 31 and coupled to an external power source. The heater supports 31 have multiple through holes 311 at the bottoms. The heater support 31 has a heater-disposing slot 312, and a heater element 40 is directly installed inside the heater-disposing slot 312 of the heater support 31. The heater element 40 may be an electrothermal filament and can be installed via penetrating the through holes 311 to fit into the heater-disposing slot 312. The heater element 40 may also be fabricated together with the heater supports 31 via injection-molding the heater supports 31 with the heater element 40 embedded thereinside. Multiple heat-conducting elements 50, which can increase heat-spreading area, overlay the heater supports 31 to receive the heat from the heater element 40. Refer to from FIG. 5 to FIG. 7. The perimeter of the heater support 31 has multiple installing holes 313. The heat-conducting element 50 has multiple fixing platelets 52 extending through the installing holes 313. The fixing platelet 52 has a fixing hole 511, and an insertion element 512 is inserted through the fixing holes 511 to fix the heat-conducting element 50. A sealing cap 52 is used to cover the opening at the top of the heat-conducting element 50. Further, a temperature-control element 41 can be installed on the heater element 40. The temperature-control element 41 is used to preset the maximum heating temperature according to the parameters, such as the size or the material of the hair curler A1. Furthermore, a display element 42 can be installed on the heater element 40, and corresponding to the display element 42, a lampshade 33 can be installed on the disposing seat 30, and the lower casing 20 has a display hole 21 to install the display element 42 and the lampshade 33.

When the user switches on the heater device for hair curlers A1 of the present invention, the display element 42 lights to indicate for the user that the hair curlers A1 are being heated. The heater element 40 will be driven by power to heat the heat-conducting elements 50. The heat-conducting elements 50 can be uniformly heated from top to bottom by the heater element 40 and have a large heat-conducting area. The hair curlers A1 hood the heat-conducting elements 50; thereby, the hollow heat-receiving cylinders A2 can be uniformly heated and rapidly accumulate heat energy, and the user can rapidly obtain the uniformly heated hair curlers A1 to undertake a hair curling.

Those described above are only the preferred embodiments of the present invention but not to limit the scope of the present invention. Any modification and variation according to the spirit of the present invention is to be included within the scope of the present invention.

What is claimed is:

1. A heater device for hair curlers, comprising:

an upper hood and a lower casing, providing a disposing space for at least one hair curlers;

a disposing seat, installed fixedly inside said disposing space, and having multiple heater supports with the same number as said hair curlers;

a heater part, coupled to an external power source, and further comprising:

a heater element, directly installed on said heater supports; and multiple heat-conducting elements, separately overlaying each said heater support to receive the heat from said heater element and to increase heat-conducting area;

wherein said hair curlers separately hood each said heat-conducting element to achieve a rapid and uniform heating;

each said heater support has through holes at the bottom, and each said heater support has a heater-disposing slot, and entire said heater element penetrates all said through holes and disposed on all said heater-disposing slots of all said heater supports.

2. The heater device for hair curlers according to claim 1, wherein said heater element is an electrothermal filament.

3. The heater device for hair curlers according to claim 1, wherein a temperature-control element is connected to said heater element.

4. The heater device for hair curlers according to claim 1, wherein a display element is installed on said heater element, and said lower casing has a display hole to install said display element.

5. The heater device for hair curlers according to claim 4, wherein corresponding to said display element, a lampshade is installed on said disposing seat.

6. The heater device for hair curlers according to claim 1, wherein a fixing element bent and having elasticity is installed between said disposing seat and said lower casing, and said disposing seat has fixing holes to receive said fixing element, and said lower casing has fixing rabbets to snap-fit said fixing element.

7. The heater device for hair curlers according to claim 1, wherein the perimeter of said heater support has multiple installing holes, and the bottom of said heat-conducting element has multiple fixing platelets extending through said installing holes, and said fixing platelet has a fixing hole, and an insertion element is inserted through said fixing holes to fix said heat-conducting element.

8. The heater device for hair curlers according to claim 1, wherein said heat-conducting element further has a sealing cap.

* * * * *